US010483068B1

(12) United States Patent
Sinha et al.

(10) Patent No.: US 10,483,068 B1
(45) Date of Patent: Nov. 19, 2019

(54) SWITCH DISCONNECTOR SYSTEMS SUITABLE FOR MOLDED CASE CIRCUIT BREAKERS AND RELATED METHODS

(71) Applicant: Eaton Intelligent Power Limited, Dublin (IE)

(72) Inventors: Deepshikha Sinha, Vadodara (IN); Amol Bhagat, Satara (IN); Mahesh Balakrishna Varrier, Perambra (IN); Pravin Kulkarni, Pune (IN); Richard Malingowski, McDonald, PA (US); Xin Zhou, Wexford, PA (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/216,121

(22) Filed: Dec. 11, 2018

(51) Int. Cl.

| | |
|---|---|
| ***H01H 73/04*** | (2006.01) |
| ***H01H 73/06*** | (2006.01) |
| ***H01H 73/18*** | (2006.01) |
| ***H01H 73/20*** | (2006.01) |

(52) U.S. Cl.
CPC ..... *H01H 73/20* (2013.01); *H01H 73/04* (2013.01); *H01H 73/18* (2013.01); *H01H 73/06* (2013.01); *H01H 2239/044* (2013.01)

(58) Field of Classification Search
CPC ..... H01H 73/04; H01H 73/18; H01H 73/20; H01H 9/30; H01H 71/0235; H01H 71/08; H01H 50/02; H01H 9/345; H01H 9/346; H01H 33/04; H01H 1/34; H01H 1/40; H01H 1/64; H01H 2001/506; H01H 2001/508; H01H 9/02; H01H 9/36; H01H 9/38; H01H 9/44; H01T 4/14
USPC ..... 218/32, 1, 15, 16, 17, 20, 30, 33, 34; 335/201, 202; 200/249, 251
See application file for complete search history.

(56) References Cited

U.S. PATENT DOCUMENTS

| | | | | |
|---|---|---|---|---|
| 2,738,445 | A | 3/1956 | Hammerly | |
| 2,769,066 | A | 10/1956 | Cellerini | |
| 2,898,427 | A | 8/1959 | Nadeau | |
| 2,907,849 | A | 10/1959 | Kobryner | |
| 3,071,666 | A | 1/1963 | Ellsworth et al. | |
| 3,242,257 | A | 3/1966 | Jones et al. | |
| 3,662,133 | A * | 5/1972 | Bould | H01H 33/08 218/151 |
| 3,761,660 | A | 9/1973 | Jones | |
| 3,922,586 | A | 11/1975 | Buxton et al. | |

(Continued)

FOREIGN PATENT DOCUMENTS

| | | | |
|---|---|---|---|
| FR | 2905797 | * 3/2008 | H01H 9/34 |
| FR | 2959347 | 10/2011 | |

OTHER PUBLICATIONS

Translation of FR2905797 (original document published Mar. 14, 2008) (Year: 2008).*

(Continued)

*Primary Examiner* — Edwin A. Leon
*Assistant Examiner* — William A Bolton
(74) *Attorney, Agent, or Firm* — Myers Bigel, P.A.

(57) ABSTRACT

Circuit breakers are configured with line terminal geometry that drives the current from a terminal input in a direction that can reduce electromagnetic forces and that can also or alternatively include an arc chute assembly that can reduce repulsive electromagnetic forces to improve the operating level of withstand current (Icw).

22 Claims, 8 Drawing Sheets
(2 of 8 Drawing Sheet(s) Filed in Color)

(56) References Cited

U.S. PATENT DOCUMENTS 4,024,441 A 5/1977 Coyle et al.
4,081,852 A 3/1978 Coley et al.
4,251,851 A 2/1981 Diersing et al.
4,283,100 A 8/1981 Griffin et al.
4,375,021 A 2/1983 Pardini et al.
4,404,521 A 9/1983 Fennell
4,472,761 A 9/1984 Koslosky et al.
4,489,225 A * 12/1984 Masuda ..... H01H 9/362 218/149
4,503,408 A 3/1985 Mrenna et al.
4,507,709 A 3/1985 Morris et al.
4,551,597 A * 11/1985 Maier ..... H01H 1/34 200/249
4,581,511 A * 4/1986 Leone ..... H01H 73/18 200/306
4,667,263 A 5/1987 Morris et al.
4,736,174 A 4/1988 Castonguay et al.
4,786,885 A 11/1988 Morris et al.
4,851,963 A 7/1989 Miller et al.
4,866,226 A 9/1989 Hisatsune et al.
4,950,852 A 8/1990 Goldman et al.
4,970,481 A 11/1990 Arnold et al.
4,973,805 A 11/1990 Paton et al.
4,975,551 A 12/1990 Syvertson
5,072,071 A 12/1991 Cassity et al.
5,117,211 A 5/1992 Morgan et al.
5,130,504 A 7/1992 Moldovan et al.
5,179,491 A 1/1993 Runyan
5,214,402 A 5/1993 DiVincenzo et al.
5,268,661 A * 12/1993 Grunert ..... H01H 9/42 218/33
5,291,165 A 3/1994 Whipple et al.
5,293,142 A 3/1994 Fello et al.
5,317,117 A * 5/1994 Bruski ..... H01H 9/342 218/153
5,326,947 A 7/1994 Edds et al.
5,359,174 A 10/1994 Smith et al.
5,406,449 A 4/1995 Hicks et al.
5,483,211 A 1/1996 Carrodus et al.
5,583,328 A 12/1996 Mitsuhashi et al.
5,589,672 A 12/1996 Uchida et al.
5,608,367 A 3/1997 Zoller et al.
5,859,764 A 1/1999 Davis et al.
5,877,467 A 3/1999 Arnold et al.
5,906,508 A 5/1999 Jeffcoat
5,969,314 A 10/1999 Rakus et al.
5,971,801 A 10/1999 Kato et al.
6,194,983 B1 2/2001 Bogdon et al.
6,204,465 B1 * 3/2001 Gula ..... H01H 77/105 218/154
6,232,855 B1 5/2001 Malingowski et al.
6,232,857 B1 5/2001 Mason et al.
6,300,586 B1 10/2001 Doughty et al.
6,459,354 B2 10/2002 Konda et al.
6,482,048 B1 11/2002 Fleege et al.
6,545,574 B1 4/2003 Seymour et al.
6,591,482 B1 7/2003 Fleege et al.
7,009,132 B1 3/2006 Shea et al.
7,094,986 B2 8/2006 Shea
17,186,933 3/2007 Turner
7,285,742 B2 10/2007 Kinzler et al.
7,345,881 B2 3/2008 Colbert et al.
7,458,846 B2 12/2008 Loehr et al.
7,623,330 B2 11/2009 Gallas et al.
7,674,996 B2 3/2010 Shea et al.
7,898,779 B2 3/2011 Weeks et al.
8,193,459 B2 6/2012 Abroy et al.
8,222,983 B2 7/2012 Zhou et al.
8,247,727 B2 8/2012 Zhou et al.
8,420,960 B1 4/2013 Ranta
8,700,224 B2 4/2014 Mathiowetz
8,882,532 B1 11/2014 Akiyama et al.
9,029,727 B2 * 5/2015 Puhalla ..... H01H 33/20 218/148
10,034,403 B1 7/2018 Flannery et al.
2002/0154488 A1 10/2002 Leopold et al.
2003/0075784 A1 4/2003 Nakase et al.
2005/0263492 A1 12/2005 McCoy
2005/0279734 A1 12/2005 Carothers et al.
2006/0110946 A1 5/2006 Gerard
2008/0019102 A1 1/2008 Yurko
2009/0034168 A1 2/2009 Seff et al.
2012/0099279 A1 4/2012 Greenwood et al.
2012/0145675 A1 6/2012 Zhou et al.
2013/0077210 A1 3/2013 Morris
2013/0134781 A1 5/2013 Kang et al.
2013/0276361 A1 10/2013 Weeks et al.
2013/0284702 A1 10/2013 Hamada et al.
2014/0185195 A1 7/2014 Samuelson
2015/0348720 A1 12/2015 Smeltzer et al.
2016/0055993 A1 2/2016 Salaki
2017/0133789 A1 5/2017 Haegele et al.
2017/6363371 12/2017 David

OTHER PUBLICATIONS

American Society for Testing and Materials "Standard Test Method for Total Mass Loss and Collected Voiatile Condensable Materials from Outgassing in a Vacuum Environment" ASTM Designation: E 595-93 (8 pages) (1993).

Ghunem, Refat Atef "Using the Inclined-Plane Test to Evaluate the Resistance of Outdoor Polymer Insulating Materials to Electrical Tracking and Erosion" IEEE Electrical Insulation Magazine 31(5):16-22 (2015).

Product Details, Molded case circuit breakers (MCCB) for DC Breaker Service, EATON Corporation, 1 page, http://www.eaton.com/Eaton/ProductsServices/Electrical/Productsan, date unkown, printed from the internet Oct. 26, 2012.

Thangarajan et al. "A Comparison of Thermoset and Thermoplastic Arc Chutes in Molded-Case Circuit Breakers Under Fault Clearing" IEEE Electrical Insulation Magazine 31(2):30-35 (2015).

* cited by examiner

SWITCH DISCONNECTOR SYSTEMS SUITABLE FOR MOLDED CASE CIRCUIT BREAKERS AND RELATED METHODS

FIELD OF THE INVENTION

The present invention relates to circuit breakers.

BACKGROUND OF THE INVENTION

Circuit breakers are one of a variety of overcurrent protection devices used for circuit protection and isolation. The circuit breaker provides electrical protection whenever an electric abnormality occurs. In a circuit breaker, current enters the system from a power line and passes through a line conductor to a stationary contact fixed on the line conductor, then to a movable contact. The movable contact can be fixedly attached to a rotatable arm. As long as the stationary and movable contacts are in physical contact, current passes from the stationary contact to the movable contact and out of the circuit breaker to down line electrical devices.

In the event of an overcurrent condition (e.g., a short circuit), extremely high electromagnetic forces can be generated. The electromagnetic forces repel the movable contact away from the stationary contact. Because the movable contact is fixedly attached to a rotating arm, the arm pivots and physically separates the stationary and movable contacts thus tripping the circuit. Upon separation of the contacts and blowing open the circuit, an arcing condition occurs. The breaker's trip unit will trip the breaker which will cause the contacts to separate. Also, arcing occurs during normal "ON/OFF" operations on the breaker.

During certain fault interruptions, high electromagnetic forces generated internally due to high current levels can impede the breaker's ability to operate with a desired level of withstand current (Icw).

SUMMARY OF EMBODIMENTS OF THE INVENTION

Embodiments of the present invention are directed to circuit breakers that can achieve increased, desired withstand current levels.

Embodiments are directed to molded case circuit breakers.

Some embodiments are directed to circuit breakers that include a geometrically shaped line terminal that can reduce electromagnetic forces generated during a high current level condition.

Embodiments of the invention are directed to a circuit breaker with a housing, an arc chute in the housing that includes a plurality of stacked arc chute plates. The circuit breaker also includes a movable contact arm in the housing that holds a moving contact. The circuit breaker further includes a line terminal in the housing with a terminal end portion that faces a line side of the housing. The terminal end portion merges into an arm segment that has a first portion that angles toward the moving contact at a first angle. The first portion of the arm segment merges into a second portion that angles away from the moving contact at a second angle. The arm segment merges into a base segment that extends beneath the arm segment and that is coupled to a wall of the housing. The circuit breaker also includes a stationary contact in the housing and held by the arm segment of the line terminal.

The terminal end portion of the line terminal can be planar. The terminal end portion can merge directly into the first portion of the arm segment within a distance of 0.25 inches to 1 inch from an inner end of the planar terminal end portion.

The arm segment can have a peak that resides between the first and second portions, and wherein the stationary contact is held on the second portion of the arm segment.

The terminal end portion of the line terminal can be planar. The base segment can be planar and the second portion of the arm segment can be coupled to the base segment by a leg that can be perpendicular to the terminal end portion.

The first angle can be in a range of 30-75 degrees relative to a line drawn parallel to the terminal end portion of the line terminal.

The second angle corresponds to an angular extent under the peak and is in a range of 90-120 degrees.

The movable contact arm can have a forward end portion with a top. The movable contact arm including the top thereof can be external to the arc chute plates or can reside under an upper surface of an arc chute plate that is closest to the stationary contact when the moving contact and the stationary contact are coupled together in a closed position.

At least one of the arc chute plates that neighbors the stationary contact can be of a different material than at least another one of the arc chute plates.

At least the another one of the arc chute plates closest to the different material arc chute plate can be configured to be magnetized to a range of 1.50-2.00 Tesla at 5.5 kA current exposure.

The plurality of arc chute plates can be configured to have a first sub-set that has a different material than a second sub-set. The second sub-set can reside closest to the stationary contact and can be non-ferromagnetic and can produce a magnetic field at 5.5 kA that is in a range of 0.20-0.00 Tesla.

The plurality of arc chute plates can be configured to have a first sub-set that has a different material than a second sub-set and the second sub-set can reside closest to the stationary contact and bee non-ferromagnetic. The second sub-set of arc chute plates that reside closest to the stationary contact can be present in a range of 1-6 arc chute plates and can be formed of a material with a relative permeability of 1, optionally 300 series stainless steel, and further optionally 316 stainless steel.

The first sub-set of arc chute plates can be formed of a material that has a relative permeability that is at least ten times greater than the second-sub set of arc chute plates, optionally the material is low carbon steel, and further optionally carbon steel grade 1010-1012.

Other embodiments are directed to an arc chute assembly for a circuit breaker. The assembly includes: a first sidewall; a second sidewall spaced apart from and coupled to the first sidewall; and a plurality of stacked arc chute plates supported by the first and second sidewalls. A first plurality of the stacked arc chute plates can have a first material and a second plurality of the stacked arc chute plates can have a second material different from the first material. The second material is non-ferromagnetic and the first plurality of the stacked arc chute plates is present in a greater number than the second plurality of the stacked arc chute plates.

The first and second sidewalls can have opposing first and second ends with a length dimension therebetween. The first plurality of the stacked arc chute plates reside closer to the first end than the second end. The second plurality of stacked plates can reside closer to the second end than the first end.

The assembly can further include a planar top cover coupled to the first and second sidewalls. The planar top cover can have an aperture sized and configured to receive a fixation member to thereby couple the arc chute assembly to a housing of a circuit breaker.

In position in a circuit breaker proximate a stationary contact held by a line terminal, the second material can produce a magnetic field when exposed to 5.5 kA current level that is in a range of 0.20-0.00 Tesla while at least one of the arc chute plates of the first material is configured to be magnetized to a range of 1.50-2.00 Tesla at the 5.5 kA current level.

The first material of the stacked arc chute plates can be low carbon steel grade 1010-1012.

The second plurality of arc chute plates can be present in a range of 1-6 arc chute plates and can optionally be formed of a 300 series stainless steel, further optionally 316 stainless steel.

The arc chute assembly in combination with a circuit breaker. The circuit breaker includes a housing that holds the arc chute assembly; a movable contact arm in the housing and holding a moving contact; and a line terminal in the housing and comprising a terminal end portion that faces a line side of the housing. The terminal end portion can merge into an arm segment that has a first portion that angles toward the moving contact at a first angle. The first portion of the arm segment can merge into a second portion that angles away from the moving contact at a second angle. The arm segment can merge into a base segment that extends beneath the arm segment and that is coupled to a wall of the housing. The circuit breaker also includes a stationary contact in the housing adjacent the arc chute assembly and held by the arm segment of the line terminal.

Still other embodiments are directed to a circuit breaker that includes: a housing; a movable contact arm in the housing and holding a moving contact; a line terminal in the housing and comprising a terminal end portion that faces a line side of the housing; a stationary contact in the housing and held by the line terminal; and an arc chute assembly in the housing.

The are chute assembly includes: a first sidewall; a second sidewall spaced apart from and coupled to the first sidewall; and a plurality of stacked arc chute plates supported by the first and second sidewall. The first and second sidewalls of the are chute assembly have opposing first and second ends with a length dimension therebetween. The plurality of the stacked are chute plates terminate a distance from second ends of the sidewalls to define a gap space under a bottom-most are chute plate of the stacked arc chute plates. A forward end portion of the movable contact arm resides in the gap space. The movable contact arm including the forward end is external to the arc chute plates or resides under an upper surface of an arc chute plate that is closest to the stationary contact when the moving contact and the stationary contact are coupled together in a closed position.

The distance from the second ends that the stacked are chute plates terminate can in a range of 1-2 inches.

The terminal end portion of the line terminal can merge directly into an arm segment of the line terminal that has a first portion that angles toward the moving contact at a first angle. The first portion of the arm segment can merge into a second portion that angles away from the moving contact at a second angle and the arm segment can merge into a base segment of the line terminal that extends beneath the arm segment and that is coupled to a wall of the housing.

Optionally, the arc chute assembly can further include a planar cover coupled to the first and second sidewalls proximate the first ends. The planar cover can have an aperture sized and configured to receive a fixation member to thereby couple the arc chute assembly to the housing of a circuit breaker.

Still other embodiments are directed to methods of improving withstand current in a circuit breaker. The methods include: providing a circuit breaker with an arc chamber comprising an arc chute with stacked arc chute plates and a line terminal with a stationary conductor, and a movable contact arm with a moving contact, wherein the line terminal comprises a terminal end portion that faces a line side of the housing, wherein, the terminal end portion merges into an arm segment that has a first portion that angles toward the moving contact at a first angle, wherein the first portion of the arm segment merges into a second portion that angles down away from the moving contact at a second angle, wherein the arm segment merges into a base segment that extends beneath the arm segment and that is coupled to a wall of a housing of the circuit breaker, and wherein the arm segment holds the stationary contact; and directing electrical current to travel along a current path that extends from the terminal end portion of the line terminal directly to the arm segment then to the stationary contact, then to the moving contact and to the contact arm.

Still other embodiments are directed to methods that direct an electrical current to travel along a current path that extends along a line terminal that directly rises from a planar terminal end portion of the line terminal then and extends across the fixed stationary contact then to a moving contact on a movable contact arm to thereby reduce electromagnetic forces generated thereby and/or increase an operational withstand current level.

Further features, advantages and details of the present invention will be appreciated by those of ordinary skill in the art from a reading of the figures and the detailed description of the preferred embodiments that follow, such description being merely illustrative of the present invention.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

BRIEF DESCRIPTION OF THE DRAWINGS

The patent or application file contains at least one drawing executed in color. Copies of this patent or patent application publication with color drawings will be provided by the Office upon request and payment of the necessary fee.

DETAILED DESCRIPTION OF EMBODIMENTS OF THE INVENTION

Figure 1:
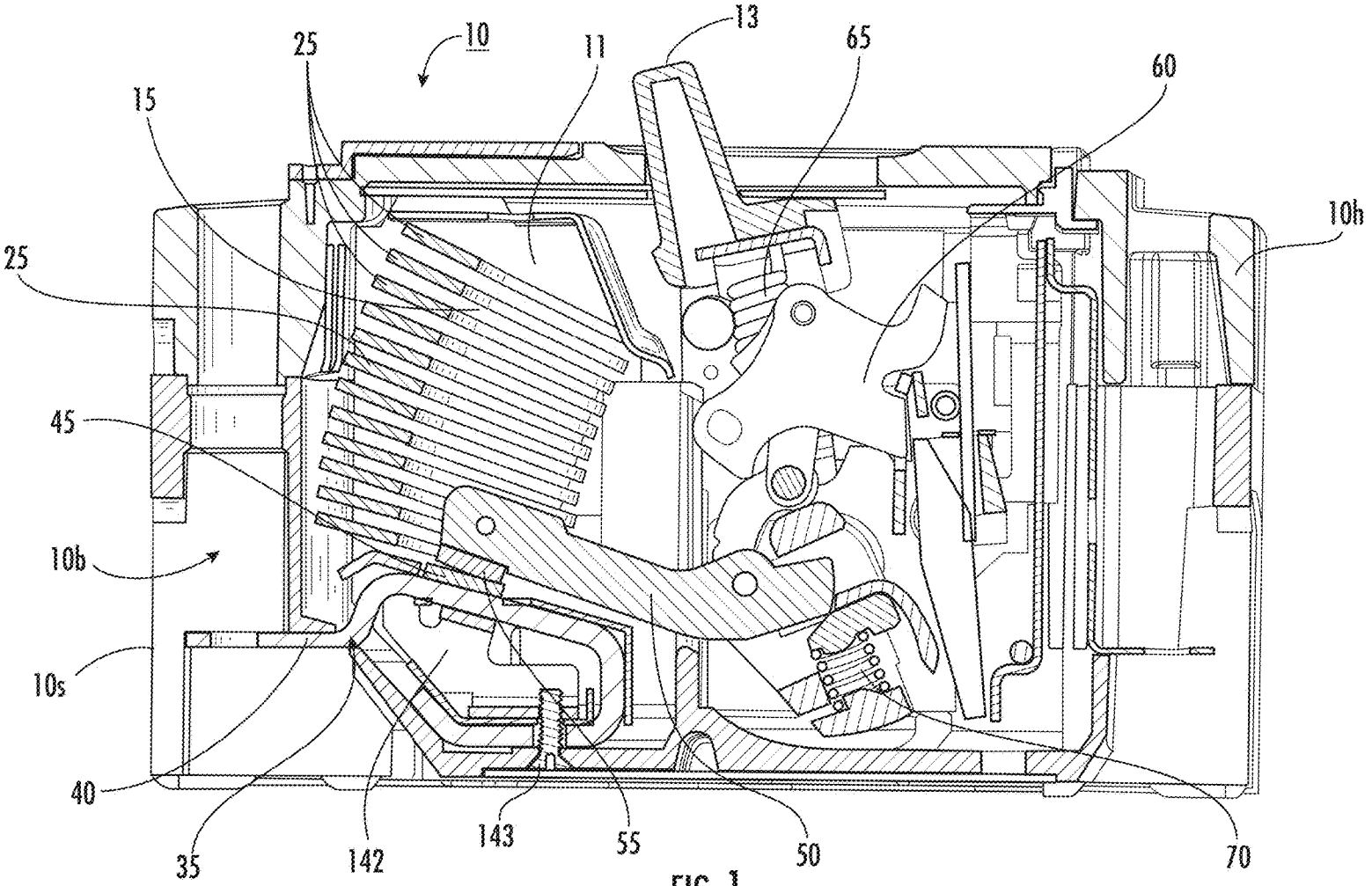
FIG. 1 is a side partial cross-section view of an exemplary circuit breaker according to embodiments of the present invention.

The present invention now will be described more fully hereinafter with reference to the accompanying drawings, in which illustrative embodiments of the invention are shown. Like numbers refer to like elements and different embodiments of like elements can be designated using a different number of superscript indicator apostrophes (e.g., 40, 40', 40", 40''').

In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90° or at other orientations) and the spatially relative descriptors used herein interpreted accordingly. The term "about" refers to numbers in a range of +/−20% of the noted value.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

Generally stated, embodiments of the present invention relate to switch disconnectors, also interchangeably referred to as a circuit interrupter and a circuit breaker. The switch disconnector is a mechanical device which is capable of carrying, making and breaking of various current levels. Embodiments of the invention can reduce the electromagnetic forces produced due to high current levels during short-circuit condition to achieve desired withstand current levels. The electromagnetic forces are the result of high current flowing through the terminal, the geometrical shapes and current direction. High electromagnetic forces are not a favorable condition for achieving desired withstand current levels. A short circuit fault or inrush current produces high current level which is several multiples of the rated current.

Due to the reverse loop formation of contacts, electromagnetic forces act on fixed and moving contacts in two opposite directions. Electromagnetic repulsive force is the main driving force for opening the contacts when short circuit or high current flows in the current path. When electromagnetic force decreases, the contacts will take more time to separate. To hold the contacts in closed position and/or to increase withstand capacity in circuit breaker, it can be desirable to reduce electromagnetic repulsive forces introduced by components of the circuit breaker.

The function of switch disconnector is to withstand the required current for a defined time. The current levels during short circuit can be sufficiently high to produce electromagnetic forces between moving and stationary contacts which eventually repel the contacts for separation against contact spring forces. The electromagnetic forces are dependent on geometry of the terminals as well as current direction. Embodiments of the invention can configure components of the switch disconnector to reduce electromagnetic forces.

Turning now to the figures, FIG. 1 illustrates a circuit breaker 10 with a handle 13 and a housing 10*h* (also known as a "cover") comprising a base 10*b*. The housing 10*h* encloses an arc chamber 11 having an arc chute assembly 15 with a plurality of spaced apart are chute plates 25. The arc chute plates 25 can be parallel (closely) stacked arc chute plates 25. In some embodiments, in the orientation shown with the handle 10*h* facing upward, the arc chute plates 25 can be oriented with an angle of inclination of between 15-30 degrees relative to horizontal. The housing 10*h* can be a molded case providing a molded case circuit breaker (MCCB).

The circuit breaker 10 also includes a line conductor assembly 35 comprising a line terminal 40 (also known as a "line conductor") coupled to a stationary contact 45. The line terminal 40 is held in the base 10*b* adjacent a line side 10*s* of the housing 10*h*. A line terminal support 142 can be held in the base 10*b*. As shown, a fixation member 143, such as a threaded screw, can be attached to the base 10*b* and to the line terminal support 42 and line terminal 40.

Still referring to FIG. 1, the circuit breaker 10 also includes a moving contact arm 50 that holds a moving/movable contact 55. The movable contact 55 can couple to the stationary contact 45. The circuit breaker 10 also includes a mechanism assembly 60 with a mechanism spring 65 that is coupled to the handle 13. The mechanism assembly 60 also includes a contact spring 70 that is coupled to the moving contact arm 50 to provide a sufficient contact force for forcibly coupling the moving contact 55 to the stationary contact 45, when in an engaged position.

Figure 2A:
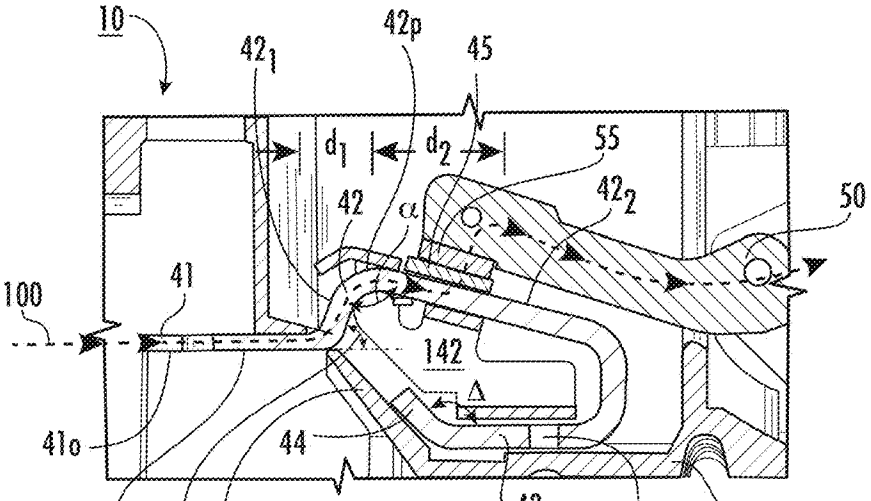
FIG. 2A is an enlarged partial side view of a portion of the circuit breaker shown in FIG. 1 with an example current path according to embodiments of the present invention.

FIG. 2A illustrates a current path 100 with arrows indicating a current in to a current out direction from the line terminal 40 to the contact arm 50. The current path 100 shown in FIG. 2A eliminates the "C-loop" current path 100' of the prior art line terminal 40' shown in FIG. 3A, which decreases electromagnetic forces generated during a high current event. A short circuit fault or an inrush current is a high current event and can create current levels that are above the rated current of the breaker 10.

Figure 2B:
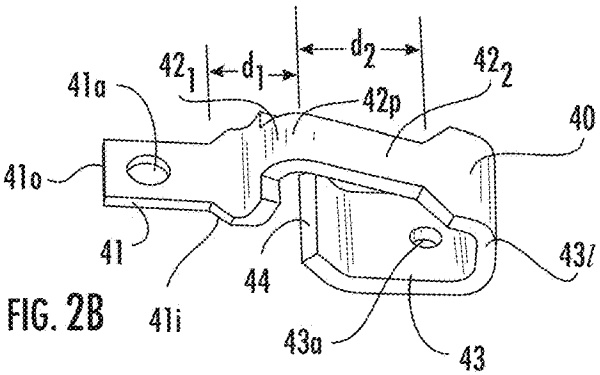
FIG. 2B is a side perspective view of the line terminal shown in FIG. 2A according to embodiments of the present invention.

Referring to FIGS. 2A and 2B, the line terminal 40 has an outer or terminal end portion 41 with an aperture 41*a* that resides adjacent a line side 10*s* of the circuit breaker 10 adjacent an outermost end 41*o* of the terminal end portion 41. The terminal end portion 41 can be planar and can have an aperture 41*a*. In the orientation shown, with the handle 13 facing upward, the terminal end portion 41 merges into an arm segment 42 that has a first portion $\mathbf{42}_1$ that rises at an angle "β" relative to the terminal end portion 41 in a direction toward the moving contact 55 to a peak 42*p*. The arm segment 42 has a second portion 422 on the other side of the peak 42*p* that angles at an angle of inclination "γ", with an angular extent under the peak 42*p*, away from the terminal end portion 41 to merge into a base segment 43 that is under the arm segment 42. $\beta<\gamma$ in the embodiment shown. In some embodiments, the angle β can be in a range of 30-75 degrees, more typically in a range of 45-70 degrees, such as about 70 degrees. The angle γ can be in a range of 90-120 degrees, more typically 95-120 degrees, such as about 95 degrees.

The base segment 43 can include a leg 43*l* that is arcuate that turns down toward the outer wall 10*w* and merges into a planar segment that faces the outer terminal end portion 41. The planar segment can comprise an aperture 43*a*.

As shown in FIGS. 2A and 28, the terminal end portion 41 can merge directly into the first portion $\mathbf{42}_1$ of the arm segment 42 with the peak 42*p* residing within a distance "$d_1$" of 0.25 inches to 1 inch from an inner end 41*i* of the planar terminal end portion and the stationary contact 45 can reside within a distance "$d_2$" of 0.25 inches to 1.5 inches from the peak 42*p*, in a direction away from the terminal end portion 41. In some embodiments, $d_2>d_1$.

Figure 10A:
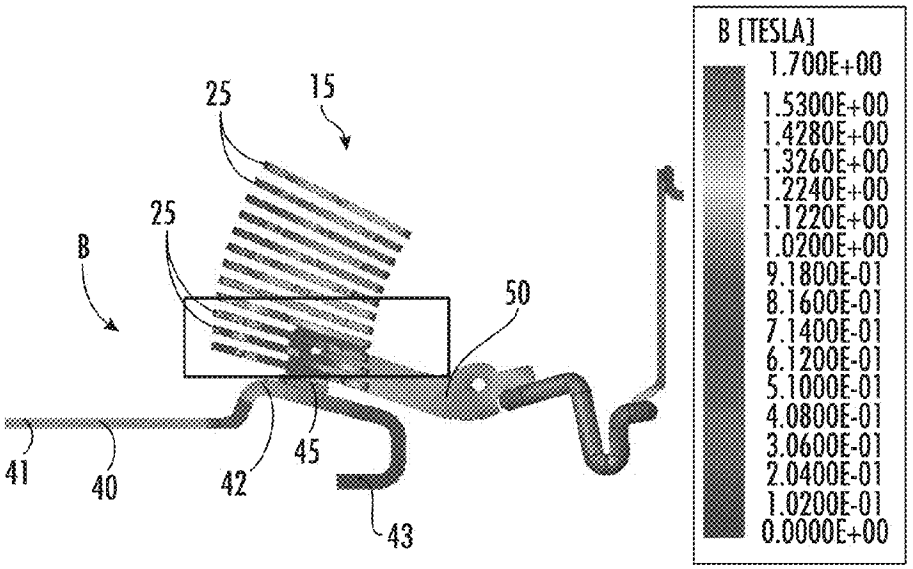
FIG. 10A is a color-coded magnetic field plot of bottom magnetic arc chute plates illustrating highly magnetized and saturation limits (at 1.2 to 1.7 Tesla).
Figure 10B:
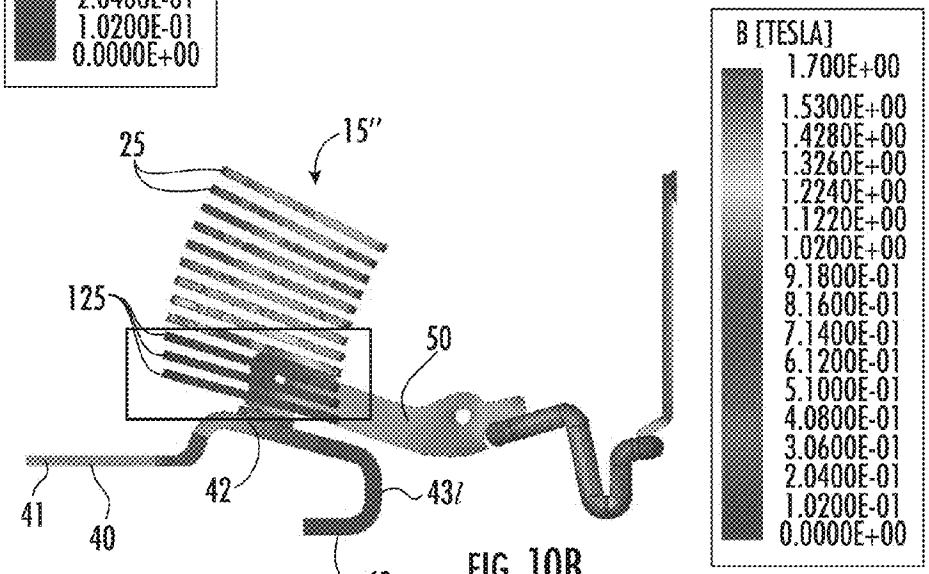
FIG. 10B is a color-coded magnetic field plot (Tesla) of bottom non-magnetic arc chute plates shown in FIGS. 5A, 5B and 6, illustrating no or greatly reduced magnetization, below 3.0600E-01 according to embodiments of the present invention.

In some embodiments, the base segment 43 can merge into an inner end 44 of the line conductor 40 that rises at an angle "Δ" upward toward the terminal end portion 41 and terminates under the arm segment 42. Where used, the angle Δ can be 90-160 degrees, measured from horizontal in the orientation shown, more typically 110-145 degrees. However, as shown in FIGS. 10A, 10B, the line terminal 40 can terminate at the base 43 and omit the angled inner end 44.

Referring again to FIG. 2A, the inner end 44 of the line terminal 40 can abut an angled inner surface 10*a* of the base 10*b*. The fixation member 143 extends through the aperture 43*a* to secure the line terminal to the outer wall 10*w*. The arm segment 42 holds the stationary contact 45. As shown, the arm segment 42 holds the stationary contact 45 closer to the outer or terminal end portion 41 than the leg segment 43*l* of the base segment 43.

Referring to FIG. 2A, the current path 100 travels over the terminal end portion 41 of the line terminal 40, rises at the first portion $\mathbf{42}_1$ of the arm segment 42, then travels up to the stationary contact 45, then to the moving contact 55, and out the moving/movable contact arm 50. The current path 100 provided by the line terminal 40 shown in FIG. 2A can increase the withstand current ("Icw") using the same contact spring and mechanism spring forces of shown in FIG. 1. The Icw evaluation can be carried out in compliance with IEC 60947-3 for Switch-Disconnect products, the contents of which are hereby incorporated by reference as if recited in full herein. The withstand current is set by design so that it is high enough to pass these tests (prevent welding, etc.), i.e., 5.5 kA Icw. Withstand level of the breaker 10 is typically 10-15 times the rated current of the breaker. In some particular embodiments, a breaker 10 can be designed for 5.5 kA peak withstand level. Typical ranges of breaker rating can be from 40 A to 2500 A.

Figure 3A:
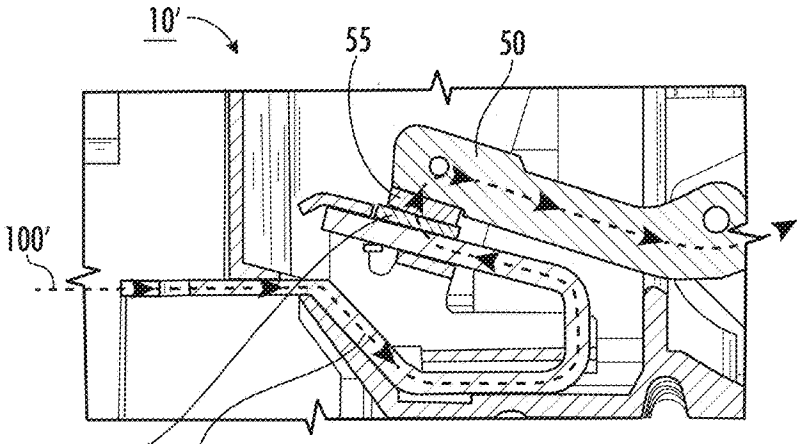
FIG. 3A (PRIOR ART)
FIG. 3A is an enlarged side partial side view of a prior art line terminal configuration and current path.
Figure 3B:
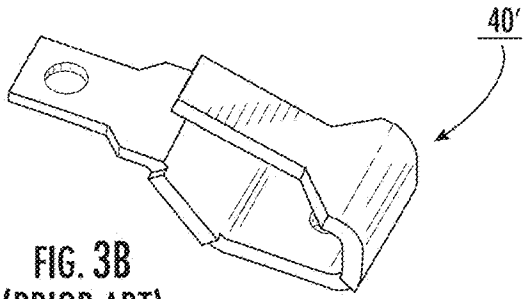
FIG. 3B (PRIOR ART)
FIG. 3B is a side perspective view of the line terminal shown in FIG. 3A.

In some embodiments, using the same circuit breaker 10 with the same contact arm 50 and mechanism assembly 60, the line terminal 40 of FIGS. 2A and 2B can increase the withstand current level by 36.4% compared to the line terminal 40' shown in FIGS. 3A and 3B.

The contact spring 70 can provide a contact force for the moving contact 55. The mechanism spring 65 can provide a spring force on the moving contact arm 50 in a direction offset from and opposing the contact spring 70. The circuit breaker 10 can be configured so that the mechanism assembly 60 operates with a reduced or minimal closing force created by the springs 65, 70 that can be in a range of 45 lbs and 14.6 lbs respectively.

In some embodiments, the line terminal 40 with the new current path 100 can be used with a conventional mechanism assembly 60 (FIG. 1) to operate with reduced contact forces, which can be in a range of 3.3 to 5.2 lbs while providing increased withstand current levels without requiring design changes to the existing mechanism assembly 60.

Figure 4B:
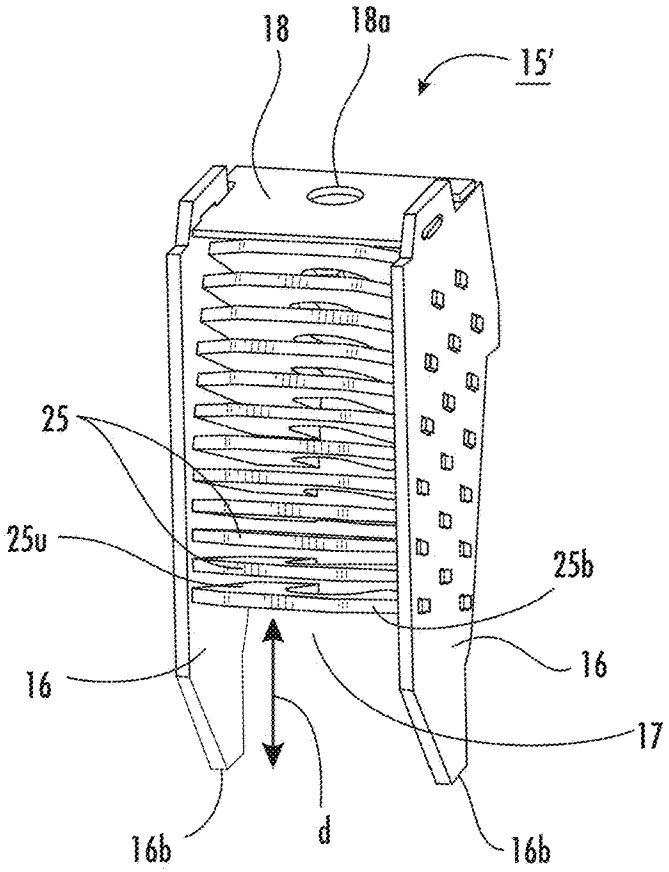
FIG. 4B is a side perspective view of the arc chute shown in FIG. 4A according to embodiments of the present invention.
Figure 4A:
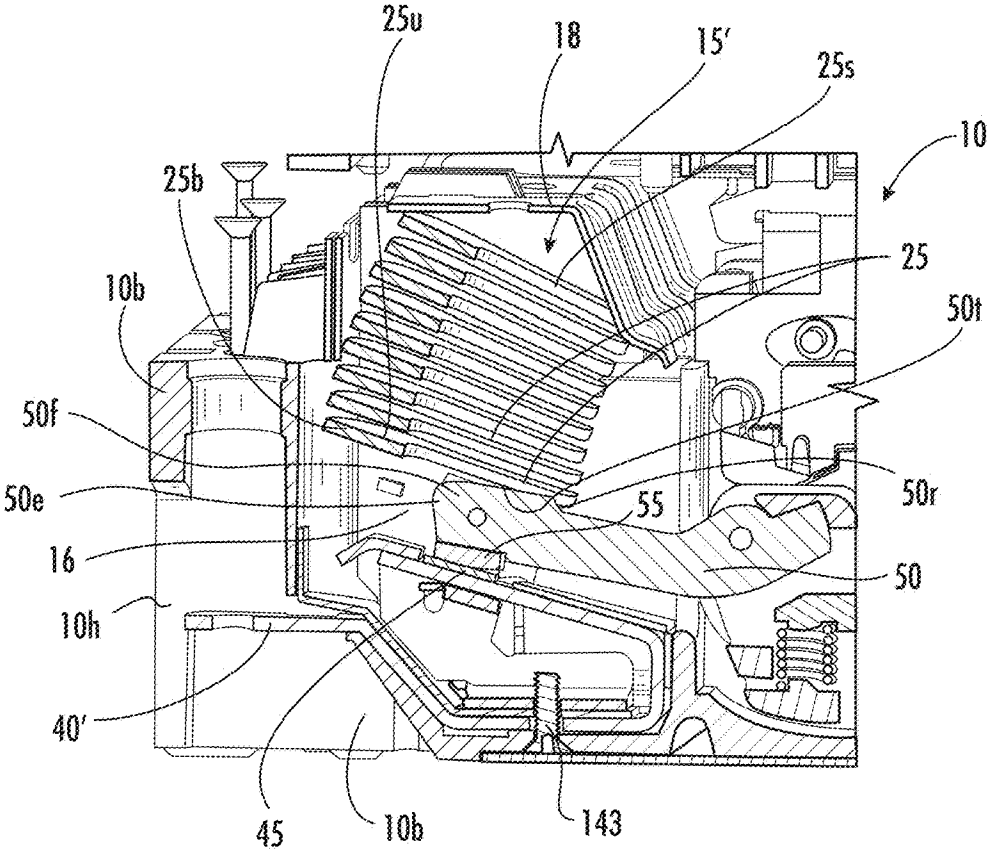
FIG. 4A is a partial section side perspective view of a circuit breaker with an alternate arc chute configuration according to embodiments of the present invention.

Turning now to FIGS. 4A and 4B, embodiments of the invention can provide arc chute assemblies 15' that can keep electromagnetic forces at reduced levels using a unique geometry and configuration to facilitate desired withstand current ("Icw") levels. One of the primary contributors of the Lorentz force acting on the moving arm 50 is due to the magnetic property of the arc chute plates 25 adjacent the arm 50. As shown in FIG. 4A, the arc chute assembly 15' can be configured so that the arc chute plates 25 terminate above or adjacent a top 50*t* of a forward portion 50*f* of the arm 50 when the arm 50 positions the movable contact 55 in the closed position against the stationary contact 45. As shown, the entire arm 50, including the top end 50*t* of the forward portion 50*f* of the arm 50, can reside below the upper surface 25*u* of the bottom arc chute plate 25*b* in the orientation shown.

As shown in FIG. 4A, the top 50*t* of a rearward portion of the 50*r* forward end portion 50*f* of the arm 50 can extend under the upper surface 25*u* of the bottom arc chute plate 25*b* while the forward end 50*e* of the forward end portion 50*f* is below this bottom arc chute plate 25*b* in the closed position with contacts 45, 55 coupled.

Referring to FIG. 4B, the arc chute assembly 15' includes opposing sidewalls 16 that support a plurality of stacked plates 25. The arc chute plates 25 have open interior spaces 25*s*. The sidewalls 16 extend a distance below the bottom arc chute plate 25*b* providing a gap space 17 that receives the forward top end of the arm 50. In some particular embodiments, the gap space 17 can extend a distance in a range of 1.00-2.00 inch above the bottom end 16*b* of the sidewalls 16. The sidewalls 16 can couple to the base 10*b* of the housing 10*h*. The top end of the arc chute assembly 15' can comprise a planar cover 18 with an aperture 18*a* that receives a fixation member (not shown) to attach the arc chute assembly 15' to the housing 10*h*.

FIG. 4A illustrates the circuit breaker 10 with a conventional line terminal 40'. Even using the conventional line terminal 40' with the "C-loop" current path (FIG. 3A), this arc chute assembly 15 configuration can increase the withstand current level Icw by about 17.5% relative to a present arc chute assembly (FIG. 1).

Figure 5B:
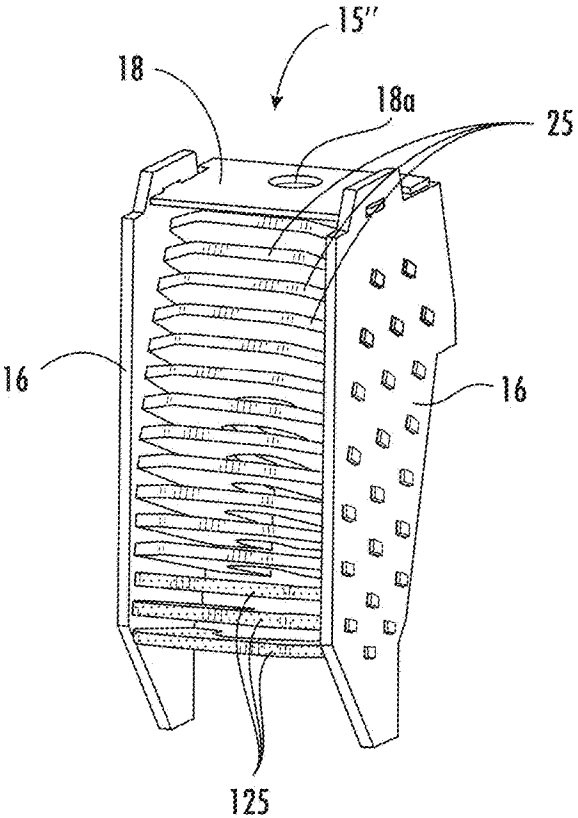
FIG. 5B is a side perspective view of the arc chute shown in FIG. 5A according to embodiments of the present invention.
Figure 5A:
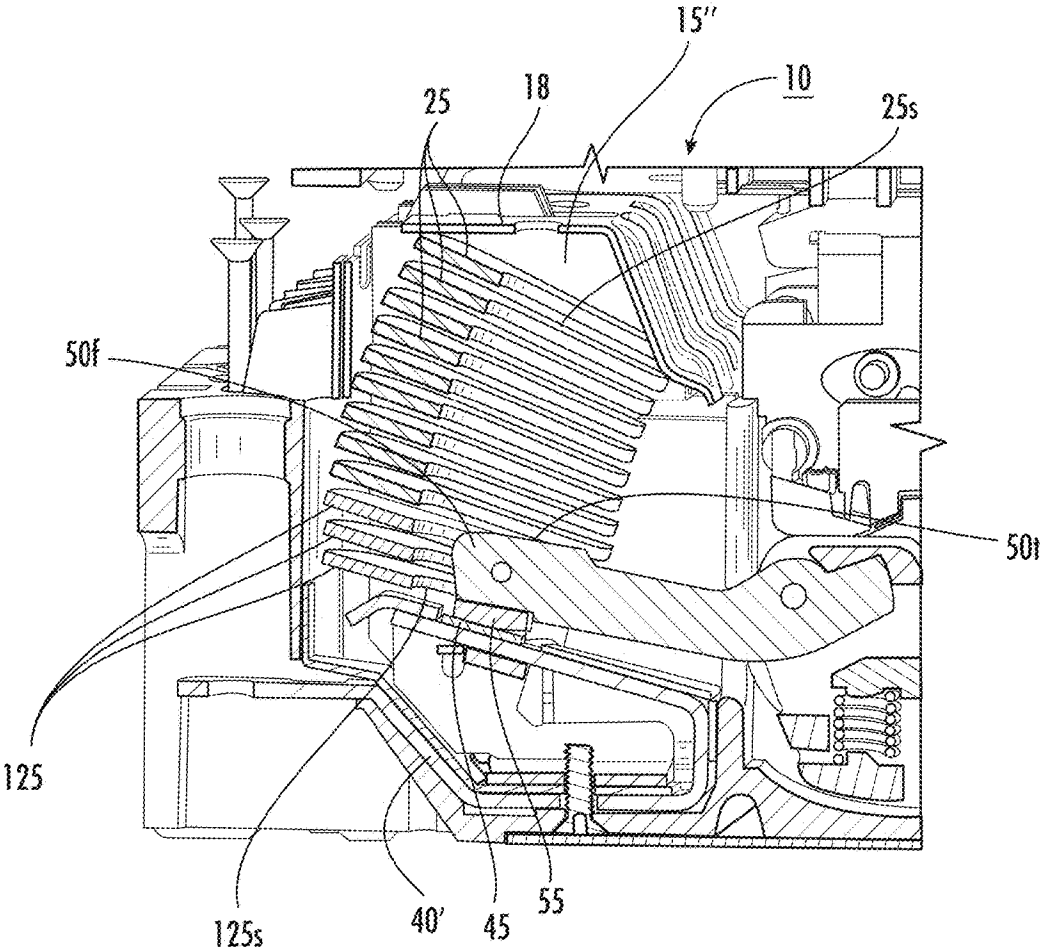
FIG. 5A is a partial section side view of a circuit breaker with an alternate arc chute configuration according to embodiments of the present invention.

Turning now to FIGS. 5A and 5B, another embodiment of the are chute assembly 15" is shown. In this embodiment, the arc chute assembly 15" comprises at least one are chute plate 125 of a different material than the arc chute plates 25. As shown, there are a plurality of adjacent arc chute plates 125 that are adjacent the arm 50 and are formed of the different material than the arc chutes 25 that reside closer to the handle 13. These are chute plates 125 have open interior spaces 125*s* that surround a forward end of the arm 50 and the top 50*t* of the forward end 50*f* of the arm 50 extends above a plurality of these arc chute plates 125.

As shown, the are chute plates 125 are provided as a set of three plates 125 but more or less of these arc chute plates 125 may be used. There are typically fewer arc chute plates 125 than the other arc chute plates 25. The number of arc chute plates 125 of different material can be in a range of 1-6, more typically in a range of 1-3, shown as three.

The arc chute plates 125 are preferably non-ferromagnetic and resistant to magnetization during an arcing or high current level event, while the other arc chutes 25 can be magnetic during an arcing event and/or when exposed to sufficiently high levels of electrical current to a level of 5.5 kA peak, for certain embodiments. Sufficiently high levels of electrical current for magnetization relate to the B-H curve of arc chute plate 25 material.

The term "non-ferromagnetic" means that the noted component is substantially free of ferromagnetic materials so as to be suitable for use in the are chamber (non-disruptive to the magnetic circuit) as will be known to those of skill in the art. For example, even when exposed to 5.5 kA (such as during testing or an arcing or high level current event), the arc chute plates 125 can be magnetized to have a magnetic field that is in a range of 0.20-0.00 Tesla while one or more of the plates 25 are capable of being magnetized to a greater amount than the range that is 2×-1000× or even greater than the arc chute plates 125. For example, the first set of arc chute plates 25 can be magnetized to 1.50-2.00 Tesla at the 5.5 kA current exposure.

The are chute plates 125 can be any grade of stainless steel material which has a relative permeability of 1.

The arc chute plates 125 can be formed of a non-ferromagnetic material that has a relative permeability of the material as 1 whereas the other arc chute plates 25 can be formed of a ferromagnetic material that has a relative permeability that is at least 10× greater in relative permeability, typically in a range of a several 100's to several 1000's. Current levels for ferromagnetic material to magnetize is decided by its B-H curve. The B-H curve is used to show the relationship between magnetic flux density (B) and magnetic field strength (H) for a particular material.

The arc chute plates 125 can be formed of an austenitic stainless steel. The arc chute plates 125 can be formed of a 300 series stainless steel, such as 316 stainless steel. The arc chute plates 25 can be formed from low carbon steel such as grade 1010-1012. The arc chute plates 125 can be formed of any suitable non-ferromagnetic material.

The arc chute assembly 15" can facilitate splitting an arc during making and breaking operations, particularly at higher current levels while also providing an increased withstand current level Icw. That is, referring to FIG. 5A, the arc chute assembly 15" even when used with the conventional line terminal 40' can provide an increased withstand current level of 17.5% compared to the arc chute assembly 15 shown in FIG. 1.

Figure 6:
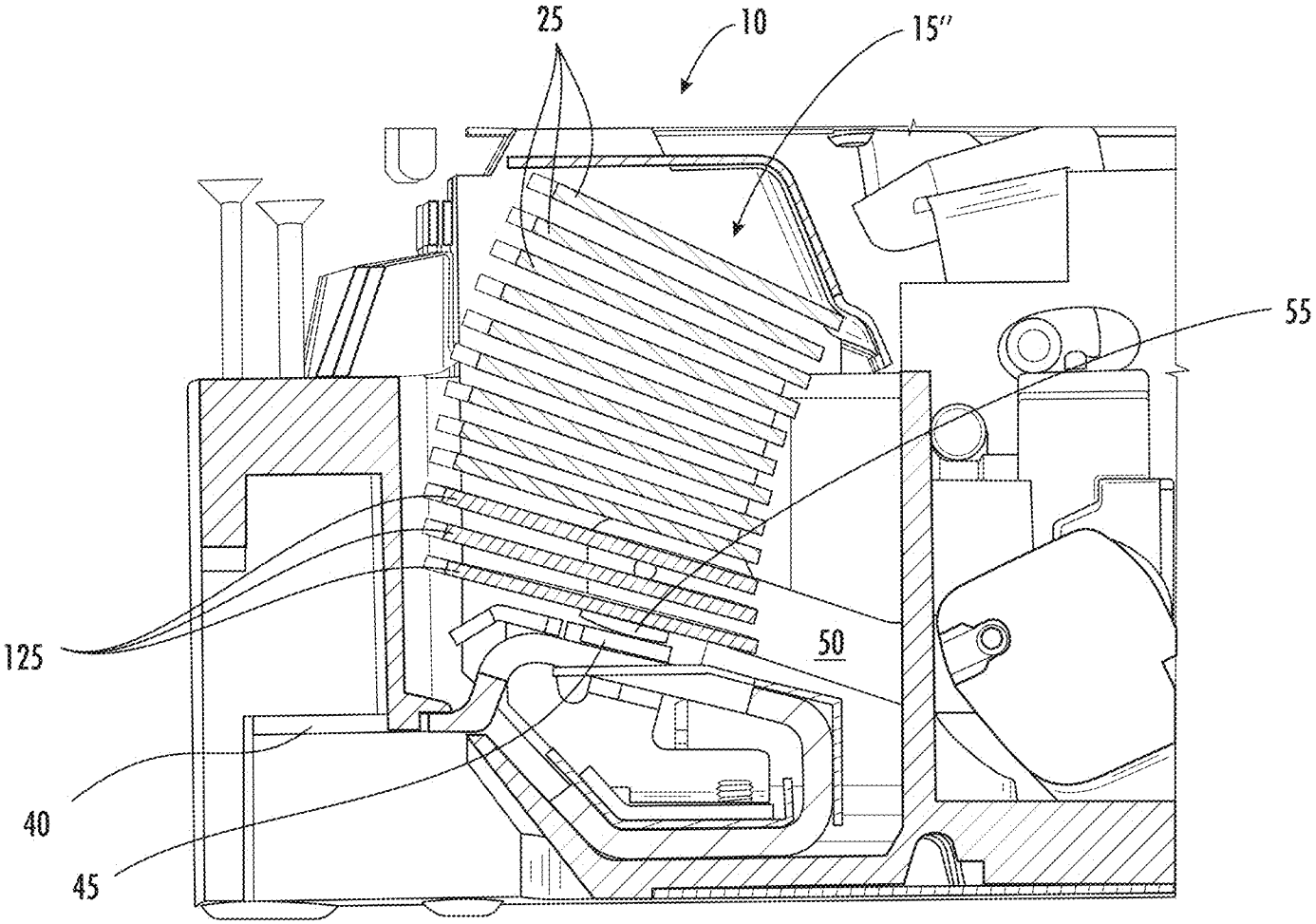
FIG. 6 is a side partial cutaway view of the arc chute shown in FIG. 5A according to embodiments of the present invention.

Turning now to FIG. 6, the are chute assembly 15" can be used with the line terminal 40 and the synergistic combination can yield even greater withstand current levels than either the line terminal 40 or the chute 15' or 15" alone, potentially increased by about 50% or more compared to existing circuit breakers 10 with the chute 15 and mechanism assembly 60 of FIG. 1.

In some embodiments, the line terminal 40, 40' comprises a non-ferromagnetic conductive material and can be a monolithic unitary member. The line terminal 40, 40' can comprise copper, a suitable grade stainless steel or any suitable non-ferromagnetic material. The stationary contact 45 and moving contact 55 are conductive, typically a silver alloy. The moving arm 50 is also conductive and non-ferromagnetic, such as copper.

Figure 7:
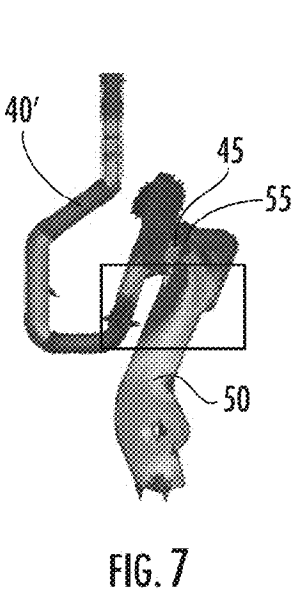
FIG. 7 (PRIOR ART)
FIG. 7 is a color-coded force density vector plot for electromagnetic forces at 5.5 kA (Icw) of the prior art line terminal configuration shown in FIGS. 3A and 3B with the prior art arc chute configuration.
Figure 8:
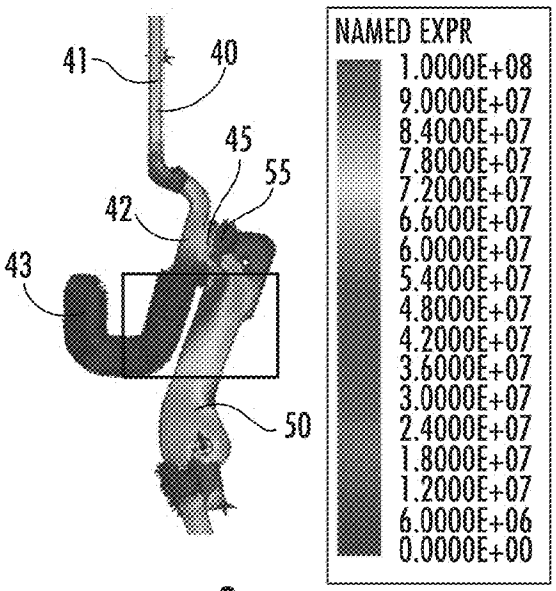
FIG. 8 is a color-coded force density vector plot for electromagnetic forces at 5.5 kA (Icw) of the line terminal configuration shown in FIGS. 2A and 2B with the prior art arc chute configuration.
Figure 9:
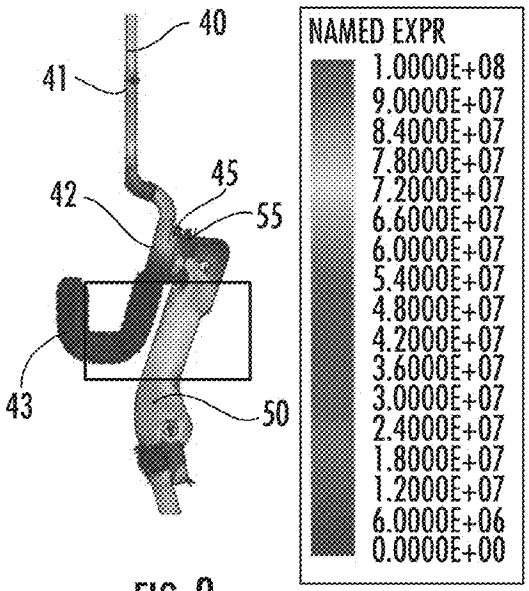
FIG. 9 is a color-coded force density vector plot for electromagnetic forces at 5.5 kA (Icw) of the line terminal configuration shown in FIGS. 2A and 2B with the arc chute configuration shown in FIG. 6.

FIGS. 7-9 are force density vector plots of the effect of electromagnetic forces at 5.5 kA (Icw) levels on the moving/movable arm 50. FIG. 7 illustrates the force density vector plot of a prior art device with an existing line terminal (FIG. 3A) and with an existing arc chute 15 (FIG. 1). FIG. 8 illustrates the line terminal 40 (FIG. 2A, 2B) with the existing arc chute assembly (FIG. 1). FIG. 9 illustrates the line terminal 40 and arc chute assembly 15" (FIG. 6). FIG. 8 illustrates a reduction in magnetic force density over FIG. 7. However, FIG. 9 clearly illustrates less magnetic force density distribution compared to either FIG. 7 or FIG. 8.

FIG. 10A illustrates a magnetic field plot for the line terminal 40 and arc chute 15 of FIG. 1. The bottom arc chute plates 25 are highly magnetized and reach saturation. FIG. 10B illustrates a magnetic field plot for the line terminal 40 and arc chute 15" of FIG. 6. The bottom arc chute plates 125 are non-ferromagnetic and show no magnetic field effect.

In some particular embodiments, the circuit breaker 10 can be a bi-directional direct current (DC) molded case circuit breaker (MCCB). See, e.g., U.S. Pat. No. 8,222,983, the contents of which are hereby incorporated by reference as if recited in full herein. The DC MCCBs can be suitable for many uses such as data center, photovoltaic and electric vehicles applications. The circuit breakers 10 can be rated for voltages between about 1 V to about 5000 volts (V) DC and/or may have current ratings from about 15 to about 2,500 Amperes (A). However, it is contemplated that the circuit breakers 10 and components thereof can be used for any voltage, current ranges and are not limited to any particular application as the circuit breakers can be used for a broad range of different uses.

In some embodiments, the circuit breakers 10 can be suitable as AC circuit breakers or both AC and DC circuit breakers.

As is known to those of skill in the art, Eaton Corp. has introduced a line of molded case circuit breakers (MCCBs) designed for commercial and utility scale photovoltaic (PV) systems. Used in solar combiner and inverter applications, Eaton PVGard™ circuit breakers are rated up to 600 amp at 1000 Vdc and can meet or exceed industry standards such as UL 489B, which requires rigorous testing to verify circuit protection that meets the specific requirements of PV systems. However, it is contemplated that the circuit breakers 10 can be used for various applications with corresponding voltage capacity/rating.

Figure 11:
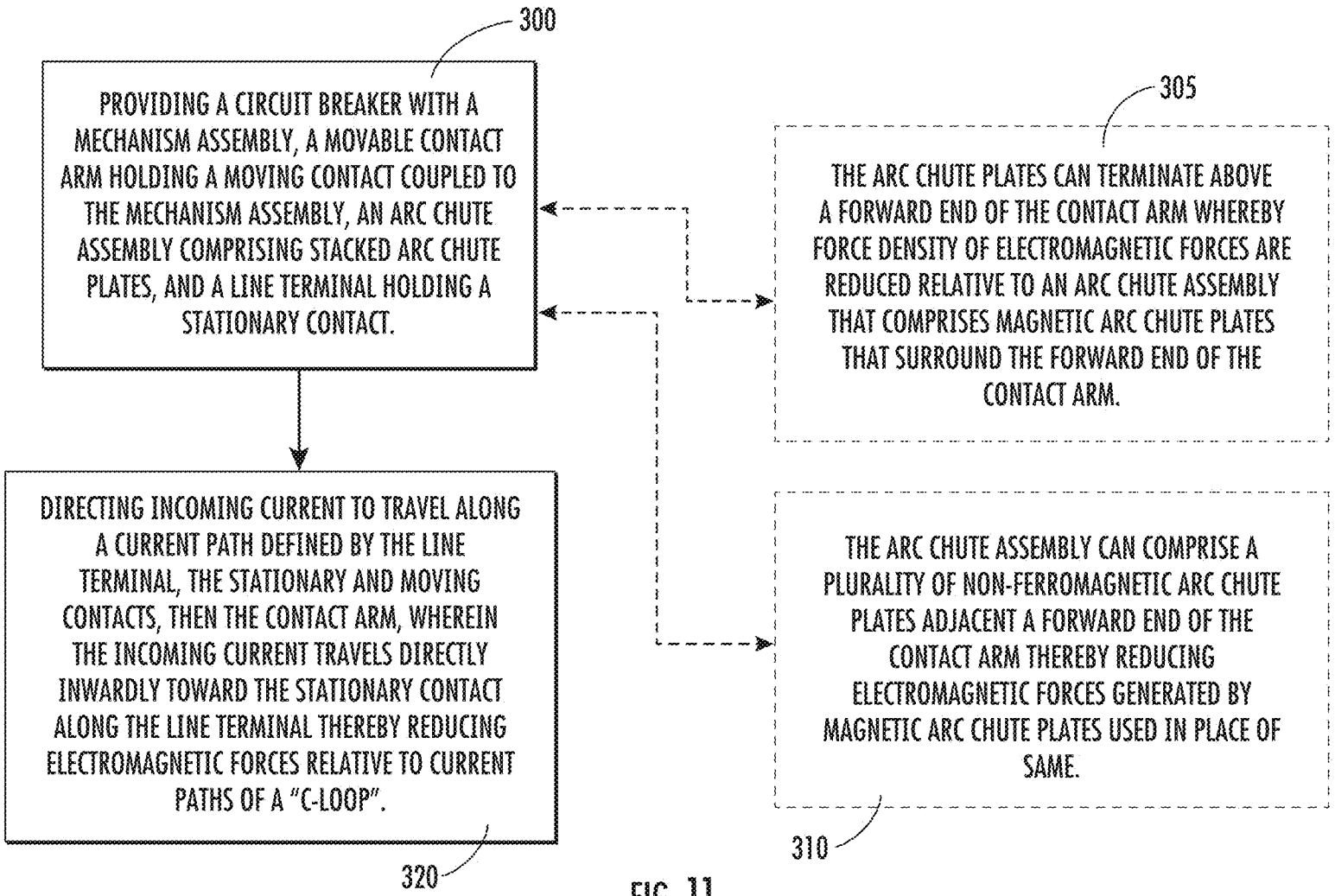
FIG. 11 is an example flow chart of a method of flowing current in a circuit breaker according to embodiments of the present invention.

FIG. 11 illustrates actions that can be carried out to reduce electromagnetic forces allowing for increased withstand current levels according to embodiments of the invention. A circuit breaker with a mechanism assembly, a movable contact arm holding a moving contact coupled to the mechanism assembly, an arc chute assembly comprising stacked arc chute plates, and a line terminal holding a stationary contact is provided (block 300). Incoming current is directed to travel along a current path defined by the line terminal, the stationary and moving contacts, then the contact arm, wherein the incoming current travels directly inwardly toward the stationary contact along the line terminal thereby reducing electromagnetic forces relative to current paths of a "C-loop" (block 320).

The arc chute plates can terminate above a forward end of the contact arm whereby force density of electromagnetic forces are reduced relative to an arc chute assembly that comprises magnetic arc chute plates that surround the forward end of the contact arm (block 305).

The arc chute assembly can comprise a plurality of non-ferromagnetic are chute plates adjacent a forward end of the contact arm thereby reducing electromagnetic forces generated by magnetic arc chute plates used in place of same (block 310).

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That Which is claimed Is:

1. A circuit breaker, comprising:

a housing;

an arc chute in the housing and comprising a plurality of stacked arc chute plates;

a movable contact arm in the housing and holding a moving contact;

a line terminal in the housing and comprising a terminal end portion that faces a line side of the housing, wherein the line terminal is a single piece shaped body, wherein the terminal end portion merges into an arm segment that has a first portion that angles upward at a first angle, wherein the first portion of the arm segment merges into a second portion that resides further away from the line side of the housing than the first portion and that angles downward from the first portion at a second angle, and wherein the second portion of the arm segment merges into a base segment that extends beneath the arm segment and that is coupled to a wall of the housing; and a stationary contact in the housing and held by the second portion of the arm segment of the line terminal, wherein the base segment comprises a leg, and wherein the second portion of the arm segment extends a distance away from the stationary contact in a direction away from the terminal end portion of the line terminal before merging into the leg of the base segment.

2. The circuit breaker of claim 1, wherein the terminal end portion of the line terminal is planar, and wherein the terminal end portion merges directly into the first portion of the arm segment within a distance of 0.25 inches to 1 inch from an inner end of the planar terminal end portion.

3. The circuit breaker of claim 1, wherein the arm segment has a peak that resides between the first and second portions.

4. The circuit breaker of claim 3, wherein the second angle corresponds to an angular extent under the peak and is in a range of 90-120 degrees.

5. The circuit breaker of claim 1, wherein the terminal end portion of the line terminal is planar, wherein the base segment is planar, and wherein the leg has a length that is perpendicular to the terminal end portion, wherein the leg comprises opposing arcuate end portions coupling the second arm portion and the base segment that extends beneath the arm segment and that is coupled to the wall of the housing.

6. The circuit breaker of claim 1, wherein the first angle is in a range of 30-75 degrees relative to a line drawn parallel to the terminal end portion of the line terminal.

7. The circuit breaker of claim 1, wherein the movable contact arm has a forward end portion with a top, wherein the movable contact arm including the top is external to the arc chute plates or resides under an upper surface of an arc chute plate that is closest to the stationary contact when the moving contact and the stationary contact are coupled together in a closed position.

8. The circuit breaker of claim 1, wherein the plurality of arc chute plates comprise a first sub-set that have a different material than a second sub-set, wherein the second sub-set reside closest to the stationary contact and are non-ferromagnetic, and wherein the second sub-set of arc chute plates that reside closest to the stationary contact are present in a range of 1-6 arc chute plates and are formed of a material with a relative permeability of 1.

9. The circuit breaker of claim 8, wherein the first sub-set of arc chute plates are formed of a material that has a relative permeability that is at least ten times greater than the second sub-set of arc chute plates.

10. The circuit breaker of claim 9, wherein the material of the second sub-set of the plurality of arc chutes is 300 series stainless steel, and wherein the material of the first sub-set of the plurality of arc chutes is low carbon steel grade 1010-1012.

11. A circuit breaker, comprising:

a housing;

an arc chute in the housing and comprising a plurality of stacked arc chute plates;

a movable contact arm in the housing and holding a moving contact;

a line terminal in the housing and comprising a terminal end portion that faces a line side of the housing, wherein, the terminal end portion merges into an arm segment that has a first portion that angles upward at a first angle, wherein the first portion of the arm segment merges into a second portion that angles away from the first portion of the arm segment at a second angle, and wherein the arm segment merges into a base segment that extends beneath the arm segment and that is coupled to a wall of the housing; and a stationary contact in the housing and held by the arm segment of the line terminal, wherein at least one of the arc chute plates that neighbors the stationary contact is of a different material than at least another one of the arc chute plates, and wherein at least the another one of the arc chute plates is configured to be magnetized to a range of 1.50-2.00 Tesla at 5.5 kA current exposure.

12. A circuit breaker, comprising:

a housing;

an are chute in the housing and comprising a plurality of stacked arc chute plates;

a movable contact arm in the housing and holding a moving contact;

a line terminal in the housing and comprising a terminal end portion that faces a line side of the housing, wherein, the terminal end portion merges into an arm segment that has a first portion that angles upward at a first angle, wherein the first portion of the arm segment merges into a second portion that angles away from the first portion at a second angle, and wherein the arm segment merges into a base segment that extends beneath the arm segment and that is coupled to a wall of the housing; and a stationary contact in the housing and held by the arm segment of the line terminal, wherein the plurality of arc chute plates comprise a first sub-set that have a different material than a second sub-set, and wherein the second sub-set reside closest to the stationary contact, are non-ferromagnetic and produce a magnetic field at 5.5 kA that is in a range of 0.20-0.00 Tesla.

13. An arc chute assembly for a circuit breaker, comprising:

a first sidewall;

a second sidewall spaced apart from and coupled to the first sidewall; and a plurality of stacked are chute plates supported by the first and second sidewalls, wherein a first plurality of the stacked arc chute plates comprise a first material and a second plurality of the stacked arc chute plates comprise a second material different from the first material, wherein the second material is non-ferromagnetic, wherein the second plurality of the stacked arc chute plates reside below the first plurality of stacked arc chute plates and, in position in the circuit breaker, are configured to be closer to a stationary contact, and wherein the first plurality of the stacked arc chute plates is present in a greater number than the second plurality of the stacked arc chute plates.

14. The are chute assembly of claim 13, wherein the first and second sidewalls have opposing first and second ends with a length dimension therebetween, wherein the first plurality of the stacked arc chute plates reside closer to the first end than the second end, wherein the second plurality of the stacked plates reside closer to the second end than the first end, wherein the assembly further comprises a planar top cover coupled to the first and second sidewalls, wherein the planar top cover comprises an aperture sized and configured to receive a fixation member to thereby couple the arc chute assembly to a housing of a circuit breaker, and wherein, in position in a circuit breaker proximate a stationary contact held by a line terminal, the second material produces a magnetic field when exposed to a 5.5 kA current level that is in a range of 0.20-0.00 Tesla while at least one of the arc chute plates of the first material is configured to be magnetized to a range of 1.50-2.00 Tesla at the 5.5 kA current level.

15. The arc chute assembly of claim 13, wherein the second plurality of arc chute plates are present in a range of 1-6 arc chute plates.

16. The arc chute assembly of claim 15, wherein the second material is 300 series stainless steel.

17. A circuit breaker comprising the arc chute assembly of claim 13, the circuit breaker further comprising:

a housing;

a movable contact arm in the housing and holding a moving contact;

a line terminal in the housing and comprising a terminal end portion that faces a line side of the housing, wherein, the terminal end portion merges into an arm segment that has a first portion that angles toward the moving contact at a first angle, wherein the first portion of the arm segment merges into a second portion that angles away from the moving contact at a second angle, and wherein the arm segment merges into a base segment that extends beneath the arm segment and that is coupled to a wall of the housing; and a stationary contact in the housing adjacent the arc chute assembly and held by the arm segment of the line terminal.

18. An arc chute assembly for a circuit breaker, comprising:

a first sidewall;

a second sidewall spaced apart from and coupled to the first sidewall; and a plurality of stacked arc chute plates supported by the first and second sidewalls, wherein a first plurality of the stacked arc chute plates comprise a first material and a second plurality of the stacked arc chute plates comprise a second material different from the first material, wherein the second material is non-ferromagnetic, wherein the first plurality of the stacked arc chute plates is present in a greater number than the second plurality of the stacked arc chute plates, and wherein the first material of the stacked arc chute plates is low carbon steel grade 1010-1012.

19. A circuit breaker comprising:

a housing;

a movable contact arm in the housing and holding a moving contact;

a line terminal in the housing and comprising a terminal end portion that faces a line side of the housing;

a stationary contact in the housing and held by the line terminal; and an arc chute assembly in the housing, the arc chute assembly comprising:

a first sidewall;

a second sidewall spaced apart from and coupled to the first sidewall; and a plurality of stacked arc chute plates supported by the first and second sidewalls, wherein the first and second sidewalls of the arc chute assembly have opposing first and second ends with a length dimension therebetween, wherein the plurality of the stacked arc chute plates terminate a distance from second ends of the sidewalls to define a gap space under a bottommost arc chute plate of the stacked arc chute plates, wherein a forward end portion of the movable contact arm resides in the gap space, and wherein the movable contact arm including the forward end is external to the arc chute plates or resides under an upper surface of an arc chute plate that is closest to the stationary contact when the moving contact and the stationary contact are coupled together in a closed position, and wherein the stationary contact resides above the terminal end portion of the line terminal wherein the distance from the second ends that the stacked arc chute plates terminate is in a range of 1-2 inches, wherein the plurality of stacked are chute plates comprise a first sub-set that have a different material than a second sub-set, and wherein the second sub-set reside closest to the stationary contact, are non-ferromagnetic and produce a magnetic field at 5.5 kA that is in a range of 0.20-0.00.

20. The circuit breaker of claim 19, wherein the terminal end portion of the line terminal merges directly into an arm segment of the line terminal that has a first portion that angles toward the moving contact at a first angle, wherein the first portion of the arm segment merges into a second portion that angles away from the moving contact at a second angle, and wherein the arm segment merges into a base segment of the line terminal that extends beneath the arm segment and that is coupled to a wall of the housing.

21. The circuit breaker of claim 19, wherein the arc chute assembly further comprises a planar cover coupled to the first and second sidewalls proximate the first ends, the planar cover comprising an aperture sized and configured to receive a fixation member to thereby couple the arc chute assembly to the housing of the circuit breaker.

22. A method of improving withstand current in a circuit breaker, comprising:

providing a circuit breaker comprising a housing with an arc chamber comprising an arc chute with stacked arc chute plates and a line terminal with a stationary contact, and a movable contact arm with a moving contact, wherein the line terminal is a single piece shaped body that comprises a terminal end portion that faces a line side of the housing, wherein, the terminal end portion merges into an arm segment that has a first portion that angles toward the stationary contact at a first angle, wherein the first portion of the arm segment merges into a second portion that angles down away from the stationary contact at a second angle, wherein the arm segment merges into a base segment that extends beneath the arm segment and that is coupled to a wall of the housing of the circuit breaker, wherein the second portion of the arm segment holds the stationary contact, wherein the base segment comprises a leg, and wherein the second portion of the arm segment extends a distance toward the first portion and a distance away from the stationary contact in a direction away from the first portion before merging into the leg of the base segment;

directing electrical current to travel along a current path that extends from the terminal end portion of the line terminal directly to the arm segment then to the stationary contact, then to the moving contact and to the contact arm; and producing a magnetic field in a first sub-set of the arc chutes when exposed to a 5.5 kA current level that is in a range of 0.20-0.00 Tesla while magnetizing a second sub-set of the arc chutes that reside above the first sub-set of the arc chutes in a range of 1.50-2.00 Tesla when exposed to the 5.5 kA current level.

* * * * *